United States Patent [19]

Bentz et al.

[11] Patent Number: 4,748,716

[45] Date of Patent: Jun. 7, 1988

[54] HINGE FOR SLEEPER CAB DOORS

[75] Inventors: Richard A. Bentz; Edmund W. Mangan, both of Fort Wayne, Ind.

[73] Assignee: Bentz Metal Products Co., Inc., Fort Wayne, Ind.

[21] Appl. No.: 919,442

[22] Filed: Oct. 16, 1986

[51] Int. Cl.[4] ..... E05D 7/04; E05D 11/06

[52] U.S. Cl. ..... 16/237; 16/248; 16/374; 16/382; 16/DIG. 21

[58] Field of Search ..... 16/234, 236, 237, 239, 16/238, 242, 243, 245, 246, 248, 355, 356, 374, 382, 50, DIG. 21, DIG. 29, DIG. 40

[56] References Cited

U.S. PATENT DOCUMENTS

| | | | |
|---|---|---|---|
| 4,186,460 | 2/1980 | Artman | 16/374 |
| 4,686,743 | 8/1987 | Suska | 16/389 |

FOREIGN PATENT DOCUMENTS

| | | | |
|---|---|---|---|
| 2024105 | 12/1971 | Fed. Rep. of Germany | 16/248 |
| 2049175 | 4/1972 | Fed. Rep. of Germany | 16/237 |

*Primary Examiner*—Nicholas P. Godici
*Assistant Examiner*—Edward A. Brown
*Attorney, Agent, or Firm*—Pearne, Gordon, McCoy & Granger

[57] ABSTRACT

A hinge for a sleeper cab compartment door that pivots between open and closed positions about a generally vertical hinge axis. The door frame has a jamb adapted to support a butt hinge and the door has a hinge stile spaced from the jamb when the door is closed so that the respective jamb and stile surfaces are separated by an elongated gap that is closed on the outer side by an elongated skirt portion extending laterally from the front panel of the door an adapted to swing inward into the gap when the door is pivoted to its open position. The jamb leaf of the hinge has a longitudinal bend dividing it into two flat flanges angularly disposed relative to one another, one of the flanges being secured to the jamb and the other forming a bearing for the hinge pin. The stile leaf also has a longitudinal bend dividing it into two flanges angularly disposed relative to one another, one of the flanges being secured to the stile and the other terminating in a bearing for the hinge pin that interfits with the bearing of the corresponding flange of the jamb leaf. When the door is opened, the edge of the skirt engages the other flange of the jamb leaf to limit the outward swing of the door an thus, prevent the outer surface from engaging the outside edge of the door frame.

1 Claim, 2 Drawing Sheets

HINGE FOR SLEEPER CAB DOORS

BACKGROUND OF THE INVENTION

This invention relates to large cargo-type automotive vehicles such as tractor/trailer rigs and especially to the cab and compartment structure for such rigs wherein, in addition to the driver's cab, there is a separate compartment or "sleeper cab". More particularly, the invention relates to a door-and-hinge construction especially adapted for sleeper cabs.

In modern tractor/trailer rigs, such as are used for hauling cargo long distances, the tractor for the rig is often provided with a separate sleeper cab located behind the driver's cab for use by the driver for resting and sleeping while stopped along the road. The sleeper cabs are usually fabricated of sheet metal and are fully enclosed to provide protection from the weather. Often, they have separate heating and air conditioning systems but they are rarely provided with windows since the primary purpose is to provide the driver with a sleeping facility at any time day or night.

The cabs are usually provided with a door on the driver's side of the tractor, the door being relatively small and just sufficient in size to permit entry and exit. The door is usually hinged at one side and is formed of front and rear panels spaced apart by metal frame members including stiles on opposite sides. Also, the exterior or front panel is usually provided with a perimetric skirt or lip, one or two inches wide, to aid in sealing the door opening.

With this arrangement, the hinges are generally recessed in the space between the hinge stile of the door and the adjacent jamb of the door frame which is formed in the wall of the sleeper cab. Because the hinge axis is behind the front surface of the door, when the door is pivoted to an open position beyond about 90 degrees, the front face of the door panel along the hinge side often engages the edge of the door frame thus, damaging the finished, painted surface.

In prior art practice, in order to prevent this from happening, it has been necessary to provide some sort of stop mechanism to limit the opening movement of the door to about 90 degrees. Such stop devices are, however, cumbersome and complex and their use is often impractical.

The door hinge construction of the present invention, however, eliminates the difficulties described above and affords other features and advantages heretofore not obtainable.

SUMMARY OF THE INVENTION

It is among the objects of the invention to prevent damage to the finished, painted surface of sleeper cab doors resulting from contact between the outside panel of the door and the adjacent door frame when the door is swung to an open position and beyond the 90 degree point.

Still another object of the invention is to provide an improved hinge construction for a sleeper cab door which protects the outer surface of the door against damage.

Still another object of the invention is to provide an improved means to limit the pivotable movement of a sleeper cab door when it is swung to the open position.

These and other objects and advantages are achieved with the novel hinge construction of the present invention which is adapted for sleeper cab compartment doors that pivot between open and closed positions about a generally vertical hinge axis.

The door frame has a jamb face generally perpendicular to the plane of the outer wall and adapted to support a butt hinge. The door has a hinge stile with a hinge mounting face generally perpendicular to the outside plane of the door and spaced from the jamb face when the door is closed so that the respective faces are separated by an elongated gap enclosed by the jamb and stile faces and by an elongated skirt portion extending laterally from the front panel of the door beyond the hinge mounting face and adapted to swing inward into the gap when the door is pivoted to its open position.

The butt hinge comprises an elongated hinge pin and a pair of elongated leaves including a stile leaf and a jamb leaf. The hinge pin is located in the gap closely spaced from the inner surface of the skirt and approximately midway between the jamb face and the stile face.

The jamb leaf has a longitudinal bend dividing it into two flat flanges angularly disposed relative to one another, one of the flanges engaging and being secured to the jamb and the other flange extending forwardly toward the hinge pin and terminating at its forward end in spaced projections formed into a circular cylindrical shape providing a bearing for the hinge pin. The other flange is tangent to the rounded bearing rearwardly of the hinge pin.

The stile leaf has a longitudinal bend dividing it into two flanges angularly disposed relative to one another, one of the flanges engaging and being secured to the stile and the other flange extending forwardly toward the hinge pin and terminating in spaced projections formed into a circular cylindrical shape to define a bearing for the hinge pin. The other flange is tangent to the hinge pin on the side away from the jamb. Accordingly, when the door is opened, pivoting the stile leaf more than 90 degrees about the hinge axis, the edge of the skirt engages the other flange of the jamb leaf to limit the outward swing of the door and thus prevent the outer surface of the door from engaging the outside edge of the door frame.

DESCRIPTION OF THE PREFERRED EMBODIMENT

Figure 1:
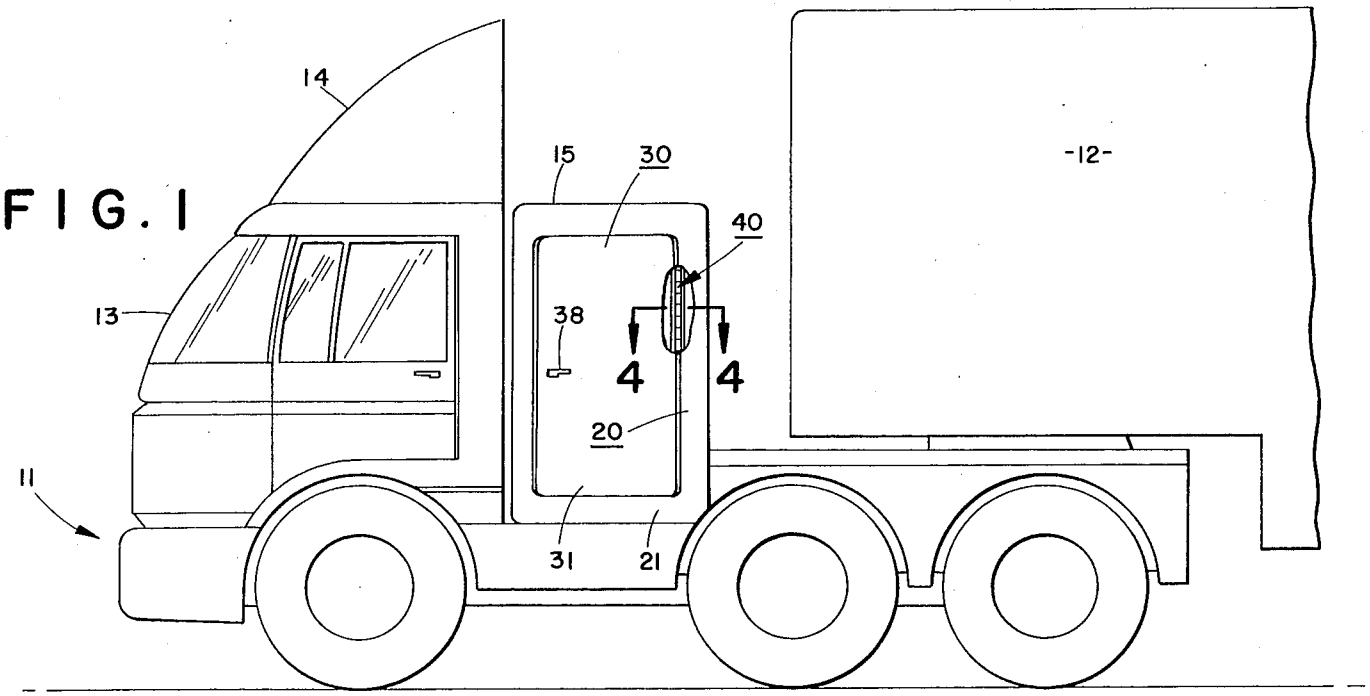
FIG. 1 shows a tractor/trailer rig including a sleeper cab with a door and hinge assembly embodying the invention.
Figure 2:
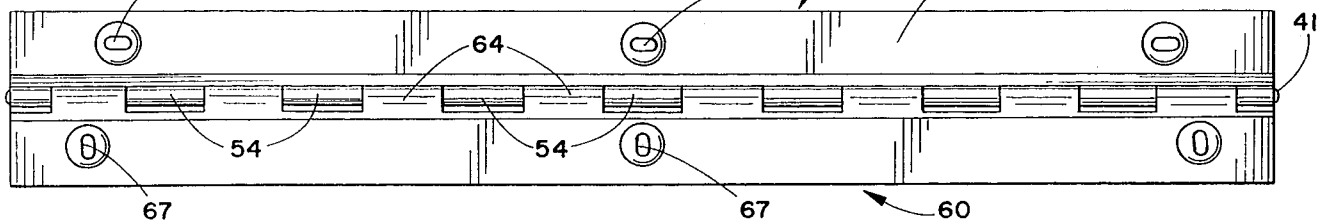
FIG. 2 is a plan view of the butt hinge of the invention.
Figure 3:
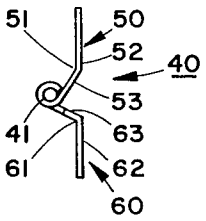
FIG. 3 is an end elevation of the butt hinge of FIG. 2.

Referring more particularly to the drawings and initially to FIG. 1, there is shown a tractor/trailer rig 10 including ten-wheeled tractor 11 and a cargo trailer 12 adapted to be towed by the tractor, such as is common in long-distance cargo hauling. The tractor has a cab 13, a wind deflector 14 and a sleeper cab 15 which is provided so that the driver may rest and/or sleep during long, cross-country hauls. The sleeper cab 15 is constructed of sheet metal and has an opening defined by a door frame 20 adapted to be closed by a door 30 that swings between open and closed positions about a butt hinge 40 recessed behind the front surface of the door frame in a gap defined by the frame and the door.

Figure 5:
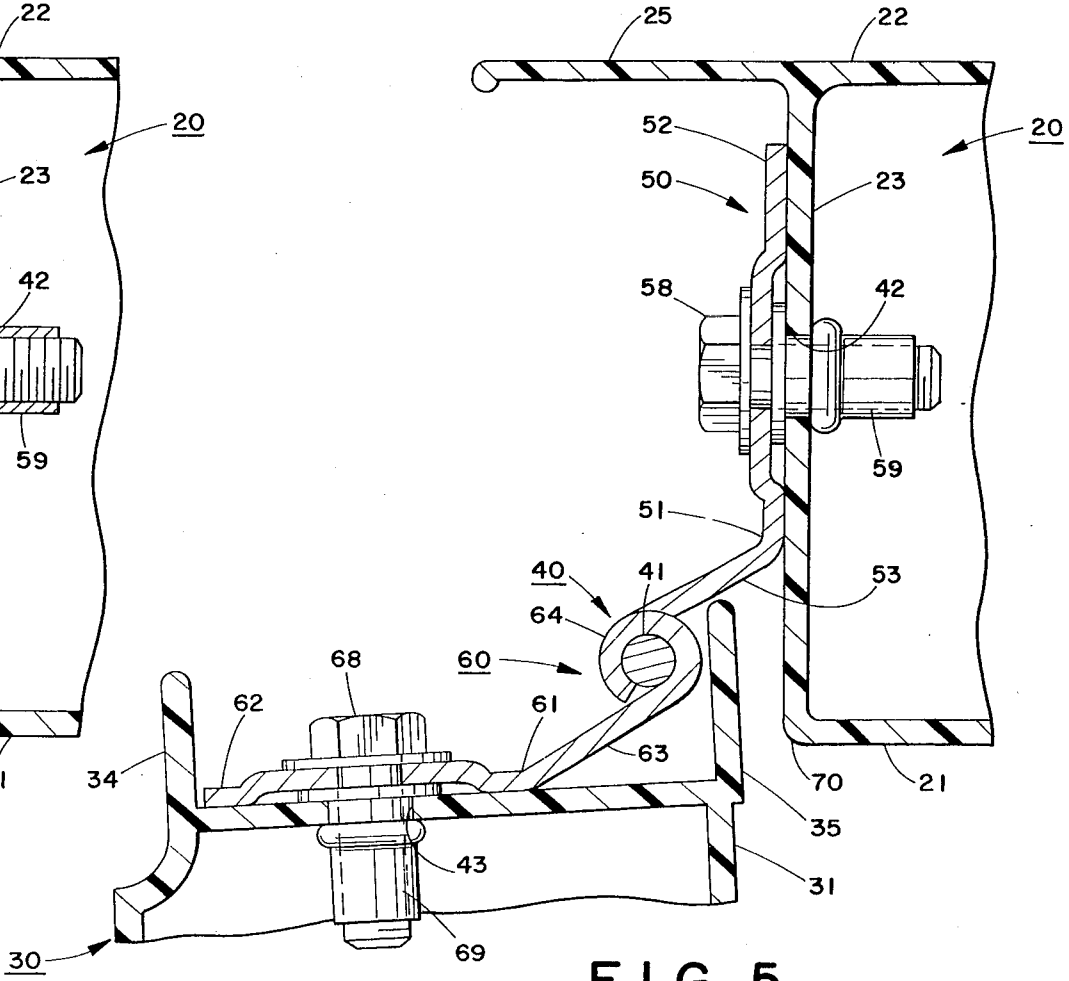
FIG. 5 is a fragmentary sectional view on an enlarged scale similar to FIG. 4 but showing the sleeper cab door pivoted to its open, limit position.
Figure 4:
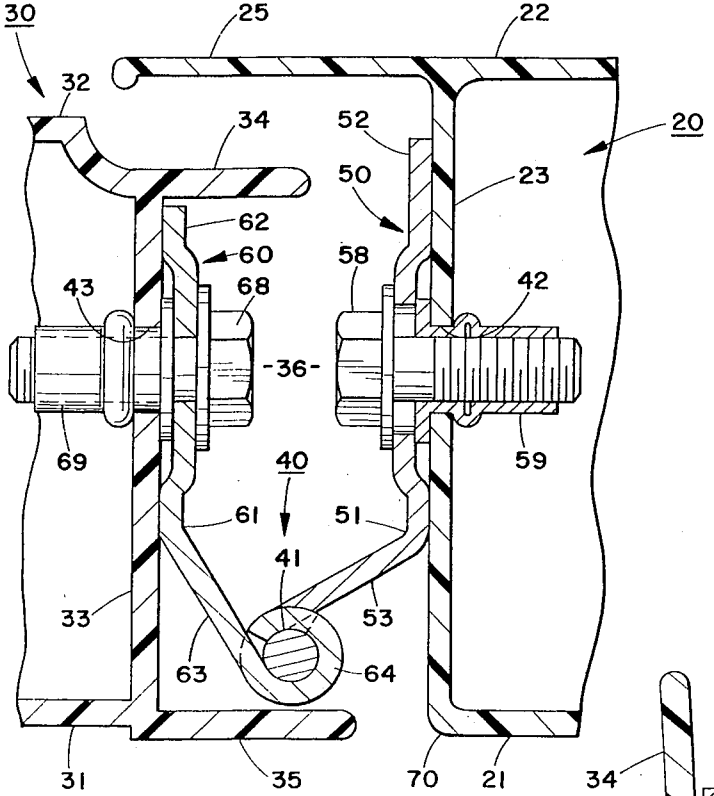
FIG. 4 is a fragmentary sectional view on an enlarged scale taken on the line 4—4 of FIG. 1.

The door frame 20 has a front panel 21 and a rear panel 22 separated from one another by frame members including a jamb plate or web 23 that is generally perpendicular to the front surface of the door frame. Referring to FIGS. 4 and 5, it will be seen that the rear panel 22 has a panel extension 25 that extends beyond the space between the door frame and the door.

The door 30 has an outside or exterior panel 31 and an inside or interior panel 32, the panels being spaced apart by a frame structure including a stile 33. The interior panel 32 has a relieved lip 34 that extends beyond the stile 33 toward the jamb plate 23 to aid in sealing the edges of the door. The exterior panel 31 of the door has a skirt extension 35 which extends across the gap between the jamb 23 and the stile 33 also to aid in closing the gap provided for the hinge and to aid in sealing.

When the door 30 is in its closed position, the stile 33, jamb 23, panel extension 25 and skirt extension 35 define a gap 36 that provides space for mounting the hinge 40. Opening and closing movement of the door 30 is facilitated by a handle 38, the door being shown in its closed position in FIG. 4 and pivoted to its open position in FIG. 5.

The hinge 40 has an elongated hinge pin 41 preferably formed of brass or other metal softer than steel, and comprises a jamb leaf 50 and a stile leaf 60. The respective leaves are mounted to the jamb 23 and stile 33 by fasteners described hereinbelow that extend through openings 42 in the jamb plate 23 and corresponding openings 43 in the stile.

The jamb leaf 50 has a longitudinal bend 51 that divides it into a mounting flange 52 and another flange 53 angularly disposed relative to the flange 52. The mounting flange rests against the hinge jamb 23 and is secured thereto as will be described hereinbelow. The other flange 53 extends angularly inward relative to the space or gap 36 and is generally tangent to the hinge pin 41 on the side of the pin 41 away from or inwardly from the skirt extension 35. The end of the flange 53 terminates in a notched portion with uniformly spaced projections 54 that are formed into a generally circular cylindrical shape to define an intermeshing bearing for the hinge pin 41.

The mounting flange 52 is provided with a plurality of linearly-spaced indentations which are in turn provided with laterally extending openings that register with the openings 42 in the jamb 23. This permits the lateral adjustment of the leaf 50 to obtain proper registration between the door 30 and the door frame 20. The flange 52 is secured to the jamb 23 by bolts 58 which engage threaded fasteners 59 referred to as "riv nuts" that are positioned in the holes 42.

The stile leaf 60 has a longitudinal bend 61 that divides it into a mounting flange 62 and another flange 63 angularly disposed relative to the flange 62. The mounting flange 62 rests against the stile 33 and is secured thereto as will be described hereinbelow. The other flange 63 terminates in a notched portion with uniformly spaced projections 64 that are formed into a circular cylindrical shape to define an intermeshing bearing for the hinge pin 41. The projections 64 of the notched portion interfit with the projections 54 of the tooth portion of the jamb leaf 50 to provide a continuous bearing for the hinge pin throughout its length. The mounting flange 62 has a plurality of uniformly, linearly-spaced indentations, each of which has an elongated opening 67 extending longitudinally relative to the leaf 60. The flange 62 is secured to the stile 33 by a plurality of machine bolts 68 extending through the openings 67 and secured in position with riv nuts 69. The longitudinally extending holes 67 provide for longitudinal adjustment of the door 30 relative to the door frame 20 to insure a proper fit.

It will be noted that the axis of the hinge pin 41 is closely spaced to the skirt extension 35 of the front panel 31 of the door and that, as the door is pivoted from its closed position to its open position, the outer edge of the skirt extension 35 eventually engages the surface of the flange 53 of the jamb leaf 50. Because of the degree of bend of the jamb leaf along the bend 51 and because the flange 53 is tangent to the hinge pin on the interior side relative thereto, sufficient space is provided for the skirt extension 35 to accommodate pivotable movement of the door of more than 90 degrees before it engages and provides a stop against the flange 53.

With this arrangement, the front surface of the door 30 does not engage the corner or edge 70 of the door frame 20 and thus, there can be no damage to the surface finish or paint on the front panel 31.

While the invention has been shown and described with reference to a preferred embodiment thereof, this is for the purpose of illustration rather than limitation and other variations and modifications of the specific construction herein shown and described will be apparent to those skilled in the art all within the spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. In combination, a vehicle door frame, a vehicle compartment door for said frame and a butt hinge for said door, said door being adapted to swing relative to a door frame between open and closed positions about a generally vertical hinge axis, said frame having a jamb generally perpendicular to the outer plane of said frame and adapted to support said hinge and said door having a hinge stile generally perpendicular to the outside plane of said door, spaced from said jamb to define therebetween an elongated gap, the front side of said gap being covered when said door is closed by an elongated skirt portion extending from the front panel of said door laterally beyond said stile and adapted to swing inward into said gap when said door is pivoted open, said butt hinge comprising an elongated hinge pin and a pair of eleongated hinge leaves including a stile leaf and a jamb leaf.

said hinge pin being located in said gap closely spaced from the inner surface of said skirt and approximately midway between said jamb and said stile.

said jamb leaf having a longitudinal bend dividing it into two flanges angularly disposed relative to one another at an angle somewhat greater than 90°, one of said flanges engaging and being secured to said jamb and the other flange extending forwardly toward said hinge pin and terminating in spaced projections shaped into a circular cylindrical bearing for said hinge pin, said other flange being tangent to said cylindrical bearing rearwardly of said hinge pin, and defining an acute angle with said outer plane of said frame, said stile leaf having a longitudinal bend dividing it into two flanges, angularly disposed relative to one another, one of said flanges engaging and being secured to said stile and the other flange extending toward said hinge pin and terminating in spaced projections shaped into a circular cylindrical bearing for said hinge pin, said other flange being tangent to said cylindrical bearing on the side away from said jamb leaf, whereby when said door is swung open more than 90°, the edge of said skirt engages the other flange of said jamb leaf to limit the outward swing of said door and prevent the outer surface of said door from engaging the edge of said jamb, said skirt when engaging said other flange of said jamb being close to normal thereto.

* * * * *